US006050921A

United States Patent [19]

Wang

[11] Patent Number: 6,050,921

[45] Date of Patent: Apr. 18, 2000

[54] TOP WEIGHTED SHOCK ABSORPTION STRUCTURE

[76] Inventor: Leao Wang, No.1, Lane 154, Charng Long Rd., Taiping City, Taichung Hsien, Taiwan

[21] Appl. No.: 09/139,111

[22] Filed: Aug. 24, 1998

[51] Int. Cl.[7] ..... A63B 22/02

[52] U.S. Cl. ..... 482/54; 482/52; 248/291.1

[58] Field of Search ..... 482/54, 51, 52; 248/567, 587, 595, 610, 611, 636, 581, 291.1, 324

[56] References Cited

U.S. PATENT DOCUMENTS

| | | | |
|---|---|---|---|
| 1,841,806 | 1/1932 | Harris | 248/291.1 |
| 4,350,336 | 9/1982 | Hanford | 482/54 |
| 5,072,928 | 12/1991 | Stearns et al. | 482/54 |
| 5,081,991 | 1/1992 | Chance | 482/54 |
| 5,184,988 | 2/1993 | Dunham | 482/54 |
| 5,192,255 | 3/1993 | Dalebout et al. | 482/54 |
| 5,279,528 | 1/1994 | Dalebout et al. | 482/54 |
| 5,596,819 | 1/1997 | Goldston et al. | 36/35 R |
| 5,823,543 | 10/1998 | Burns et al. | 280/11.22 |
| 5,827,155 | 10/1998 | Jensen et al. | 482/54 |
| 5,860,894 | 1/1999 | Dalebout et al. | 482/54 |

*Primary Examiner*—Richard J. Apley
*Assistant Examiner*—Justine R. Yu
*Attorney, Agent, or Firm*—Dougherty & Troxell

[57] ABSTRACT

This invention relates to a top weighted shock absorption structure for jogging machines. The principal element of the invention is the location of a curved linked component on each side of the jogging machine frame. A flexible shock absorption unit is located at the back end of the linked component shock absorption infrastructure where the shock absorption unit is set firmly against the upper face of the block pad located inside the base structure. The function of the flexible shock absorption units and block pads effectively reduce shock to the frame during machine use.

6 Claims, 5 Drawing Sheets

TOP WEIGHTED SHOCK ABSORPTION STRUCTURE

BACKGROUND OF THE INVENTION

1. Field of the Invention

This invention refers to a new shock absorption system for jogging machines. This new shock absorption system significantly decreases vibration as well as provides a system with fewer assembly steps and lower production costs. System design also allows the two sides of the jogging board to hold relatively tighter to the machine frame so as to prevent warping and cracking of the jogging board.

2. Description of the Prior Art

Most jogging machine shock absorption systems adequately minimize vibrations to the machine frame. Diagram I shows the shock absorption system currently employed most extensively in jogging machines. U.S. Pat. Nos. 5,441,468; 5,279,528; 5,454,772; and 5,599,259 all use shock absorption systems similar to that shown in Diagram 1. Its key element connects a number of flexible connectors (10) between the jogging board (11) and frame (12). Although reducing vibration, as the system is the direct recipient of applied stress, connectors (10) are subject to harden and break over time. Moreover, to replace the connectors (10), both jogging belt (13) and jogging board (11) must be dismantled. Clearly, both the application and convenience of current technology demonstrate room for improvement Also, the jogging board (11) in the shock absorption system currently in widest use is lifted and held in place by flexible connectors (10) lining both sides of said board. This results in a gap separating the jogging board (11) from the frame (12). In other words, when the user steps on the jogging board (11) and begins to jog, stress warping is certain to occur (at the points where the user's feet step) because the board undersides (left and right) are not flush against the frame. Finally, based on our understanding that most jogging boards (11) currently in use are made of wood material, compromises to material integrity and breakage will clearly result from such stresses over time.

SUMMARY OF THE INVENTION

In light of the above, the inventor applied his many years of experience to research and produced the improvements incorporated in this new invention. The principal intent of this new invention is to offer a system that locates the shock absorption infrastructure where the axis connects to the shaft, between the frame and base (or rear grip bar). In addition to ease of assembly, the new configuration proposed by this invention will permit a tighter fit between the jogging board and frame. Benefits include extension of jogging board usable life and shock absorption/vibration minimizing capabilities far superior to systems now in popular use.

BRIEF DESCRIPTION OF THE DRAWINGS

To provide a more in depth understanding of the technical methods and structural characteristics of this invention, the following descriptions are provided to be used with the attached drawings.

DETAILED DESCRIPTION OF THE INVENTION

Figure 1:
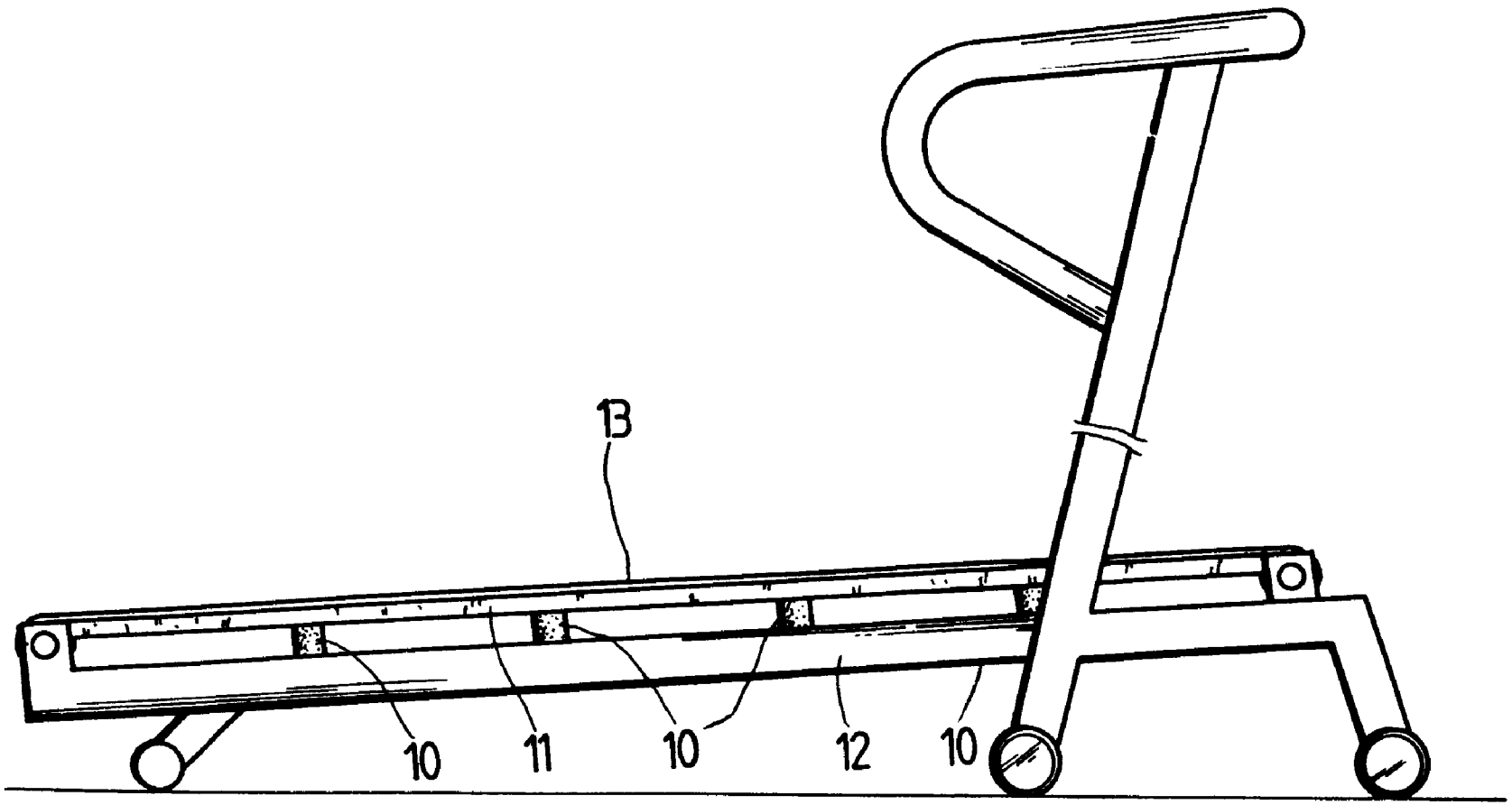
FIG. 1 PRIOR ART
FIG. 1: Side view of a known jogging machine shock absorption system currently in use.
Figure 2:
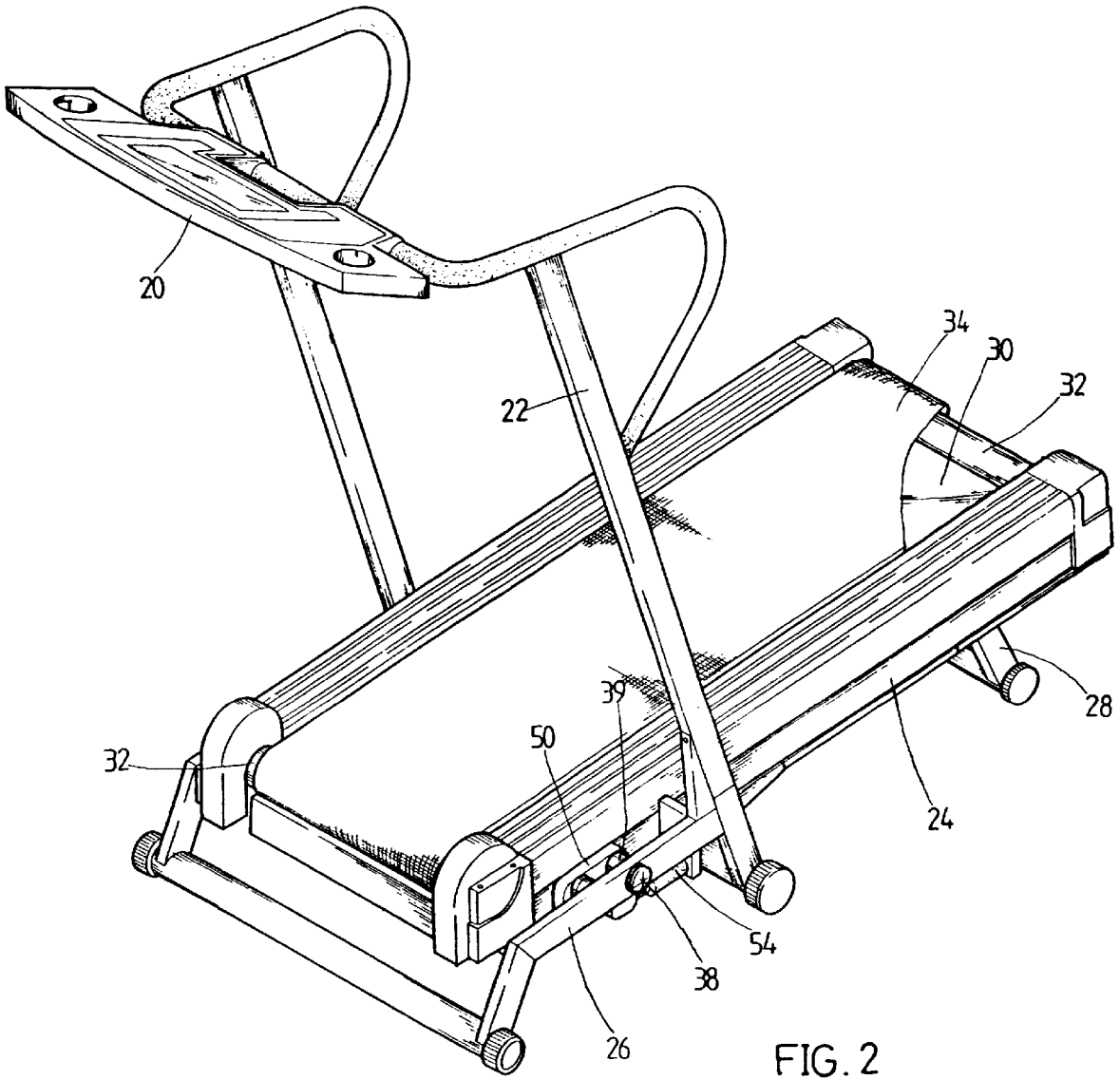
FIG. 2: Perspective view of a jogging machine according to the present invention.
Figure 3:
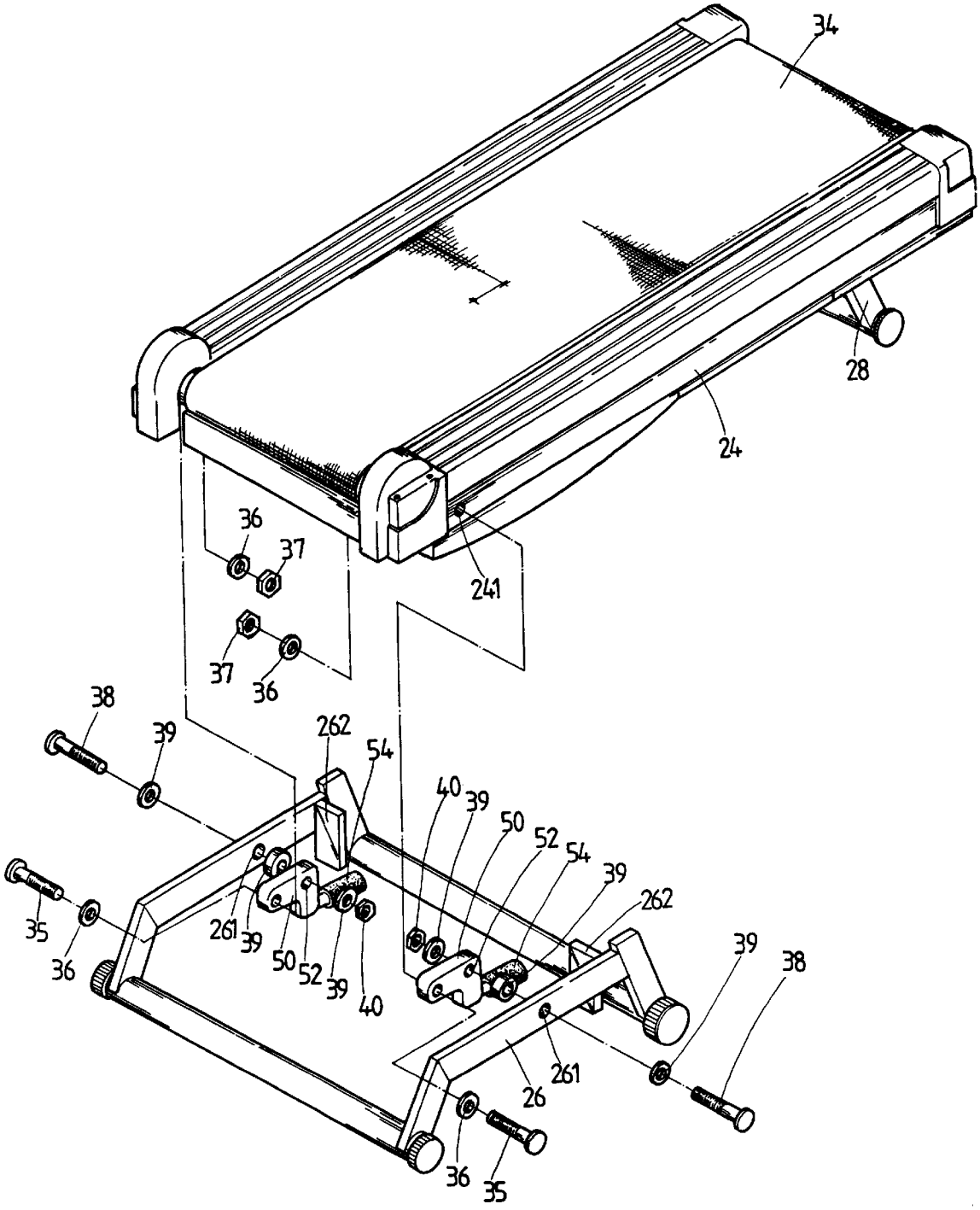
FIG. 3: Partial exploded view of this invention.
Figure 4:
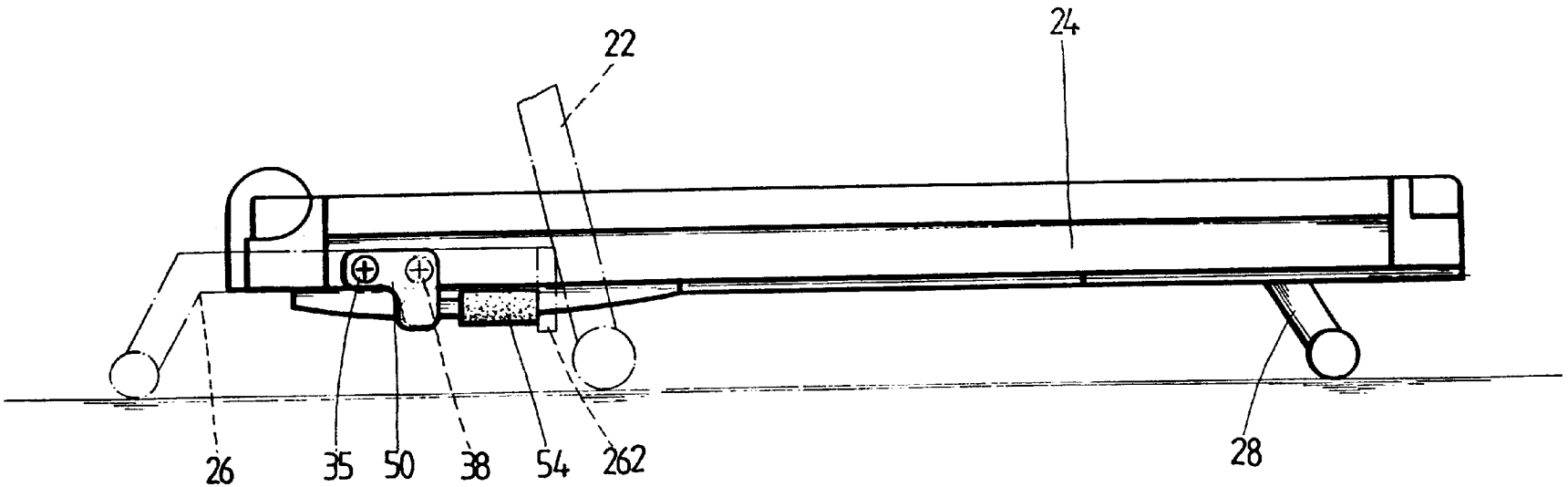
FIG. 4: Partial side view showing the above improvement implementation example in fully assembled form.
Figure 5:
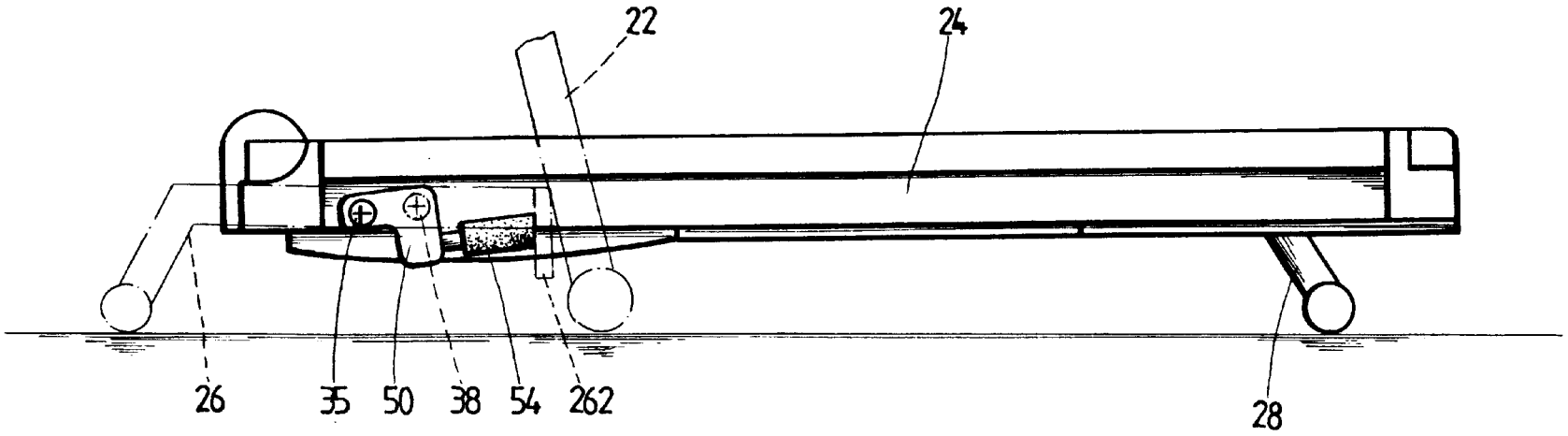
FIG. 5: Partial side view for this invention.

Firstly, examine the second and third drawings. These diagrams show that the jogging machine is composed of an electronic control board (20), a handle frame (22), the frame (24), the base (26), and rear grip bar (28). A jogging board (30) is located on the upper part of the machine frame (24). A jogging belt (34) runs between forward and rear rollers (32) on the jogging board (30). The jogging belt (34) thus is able to run its full course, permitting the user to mount the machine and begin exercises. A point of important note is the appropriately located pivot perforation (241). This perforation, together with bolts (35), washers (36), and bolt caps (37), form the linked component (50). In the midsection of this linked component (50) is another perforation (52). Combined with another set of components, bolts (38), washers (39), and bolt caps (40), it is set into the matching axis perforation on the base section (26). At the back section of the linked component (50) is a flexible shock absorption unit (54). When assembled, this shock absorption unit (54) is set firmly against the face of the block pad (262) located inside the base (26) structure.

As shown in drawings 4 and 5, after completing installation, the flexible shock absorption unit (54) is set firmly against the upper face of the block pad (262). When a user stands on the belt (34) and begins to jog and the jogging board (30) and frame (24) are strained, the flexible shock absorption unit (54) is put into use to reduce the vibration strain to the frame (24). This action also brings the two edges of the jogging board (30) into closer contact with the frame (24) to prevent warping or cracking of the jogging board.

Now, please refer to drawing 5. This invention permits shock absorption pads to be located at the axis of the frame (24) and rear grip bar (28) to achieve the same shock absorption effectiveness as observed with the system described above. Therefore, this set up requires only a set of perforations to be placed on the back two edges of the frame (24) and the rear grip bar (28). After such installation, shock absorption pads and bolt shaft (36), pads (37), bolt caps (38) may be installed accordingly Naturally, this invention is installed in a similar fashion and the linked component (50) and flexible shock absorption unit (54) are set between the frame (24) and rear grip bar (28) to achieve intended effectiveness.

In conclusion, prior to making this application, not only has a similar invention not been seen on the market or in relevant press/media, the nature of the invention demonstrates that the invention represents "new" and "improved" value added. It is believed this invention meets the requirements for a new patent application and should be entitled to patent protection under the legal application process.

What is claimed is:

1. A shock absorption structure for a jogging machine having a machine frame with a movable jogging belt thereon, the structure comprising:

a) a support base for supporting the machine frame;

b) at least one substantially L-shaped link member, said link member having one end adapted to be pivotally connected to the machine frame so as to pivot about a first axis, and pivotally connected to the support base so as to pivot about a second axis spaced from the first axis;

c) at least one block pad located on the support base, the at least one block pad having a surface facing toward the at least one link member; and, d) a flexible shock absorption unit attached to the link member, the flexible shock absorption unit bearing against the face of the at least one block pad facing toward the at least one link member.

2. The shock absorption structure of claim 1 wherein the at least one link member is adapted to be pivotally connected to the machine frame adjacent to an end of the machine frame.

3. The shock absorption structure of claim 1 further comprising:

a) two substantially L-shaped link members, each being adapted to be pivotally connected to the machine frame and to the support base;

b) two block pads located on the support base, each block pad having a surface facing toward one of the link members; and, c) two flexible shock absorption units, one flexible shock absorption unit attached to each link member and bearing against one of the two block pads.

4. The shock absorption structure of claim 3 wherein the two link members are adapted to be pivotally connected to the machine frame adjacent to an end of the machine frame.

5. The shock absorption structure of claim 3 wherein both link members are substantially cylindrical in configuration.

6. The shock absorption structure of claim 1 wherein the at least one link member is substantially cylindrical in configuration.

* * * * *